US009806400B2

(12) United States Patent
Tseng et al.

(10) Patent No.: US 9,806,400 B2
(45) Date of Patent: Oct. 31, 2017

(54) ANTENNA STRUCTURE AND WIRELESS COMMUNICATION DEVICE USING THE ANTENNA STRUCTURE

(71) Applicant: Chiun Mai Communication Systems, Inc., New Taipei (TW)

(72) Inventors: Yen-Jung Tseng, New Taipei (TW); Yi-Ting Chen, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 346 days.

(21) Appl. No.: 14/522,077

(22) Filed: Oct. 23, 2014

(65) Prior Publication Data

US 2015/0188212 A1 Jul. 2, 2015

(30) Foreign Application Priority Data

Dec. 31, 2013 (CN) ..... 2013 1 0749270

(51) Int. Cl.

| | |
|---|---|
| ***H01Q 1/24*** | (2006.01) |
| ***H01Q 21/28*** | (2006.01) |
| ***H01Q 5/335*** | (2015.01) |
| ***H01Q 5/371*** | (2015.01) |

(52) U.S. Cl.

CPC ..... *H01Q 1/243* (2013.01); *H01Q 5/335* (2015.01); *H01Q 5/371* (2015.01); *H01Q 21/28* (2013.01)

(58) Field of Classification Search

CPC ..... H01Q 1/243; H01Q 5/335; H01Q 5/371; H01Q 21/28

USPC ..... 343/702

See application file for complete search history.

(56) References Cited

U.S. PATENT DOCUMENTS

| | | | | |
|---|---|---|---|---|
| 2013/0147674 | A1* | 6/2013 | Komura | H01Q 1/38 343/750 |
| 2014/0120979 | A1* | 5/2014 | Galeev | G06F 1/1698 455/556.1 |
| 2014/0141731 | A1* | 5/2014 | Abudul-Gaffoor | H01Q 1/243 455/78 |

* cited by examiner

*Primary Examiner* — Dameon E Levi
*Assistant Examiner* — David Lotter
(74) *Attorney, Agent, or Firm* — Steven Reiss

(57) ABSTRACT

An antenna structure includes a metal member, a first antenna, a second antenna, a third antenna, and a fourth antenna. A gap is defined on the metal member to divide the metal member into a first frame assembly and a second frame assembly. The first frame assembly and the second frame assembly cooperatively form a receiving space for accommodating at least one electronic element. The first antenna, the second antenna, the third antenna, and the fourth antenna are received in the receiving space. The first antenna is electronically connected to the first frame assembly of the metal member. The third antenna and the fourth antenna are both electronically connected to the second frame assembly of the metal member.

16 Claims, 8 Drawing Sheets

ANTENNA STRUCTURE AND WIRELESS COMMUNICATION DEVICE USING THE ANTENNA STRUCTURE

FIELD

The subject matter herein generally relates to an antenna structure and a wireless communication device using the antenna structure.

BACKGROUND

Antennas are important elements of wireless communication devices, such as mobile phones, or personal digital assistants. Many wireless communication devices further employ metal housings for improving heat dissipation or other purposes.

BRIEF DESCRIPTION OF THE DRAWINGS

Implementations of the present technology will now be described, by way of example only, with reference to the attached figures, wherein.

DETAILED DESCRIPTION

Figure 1:
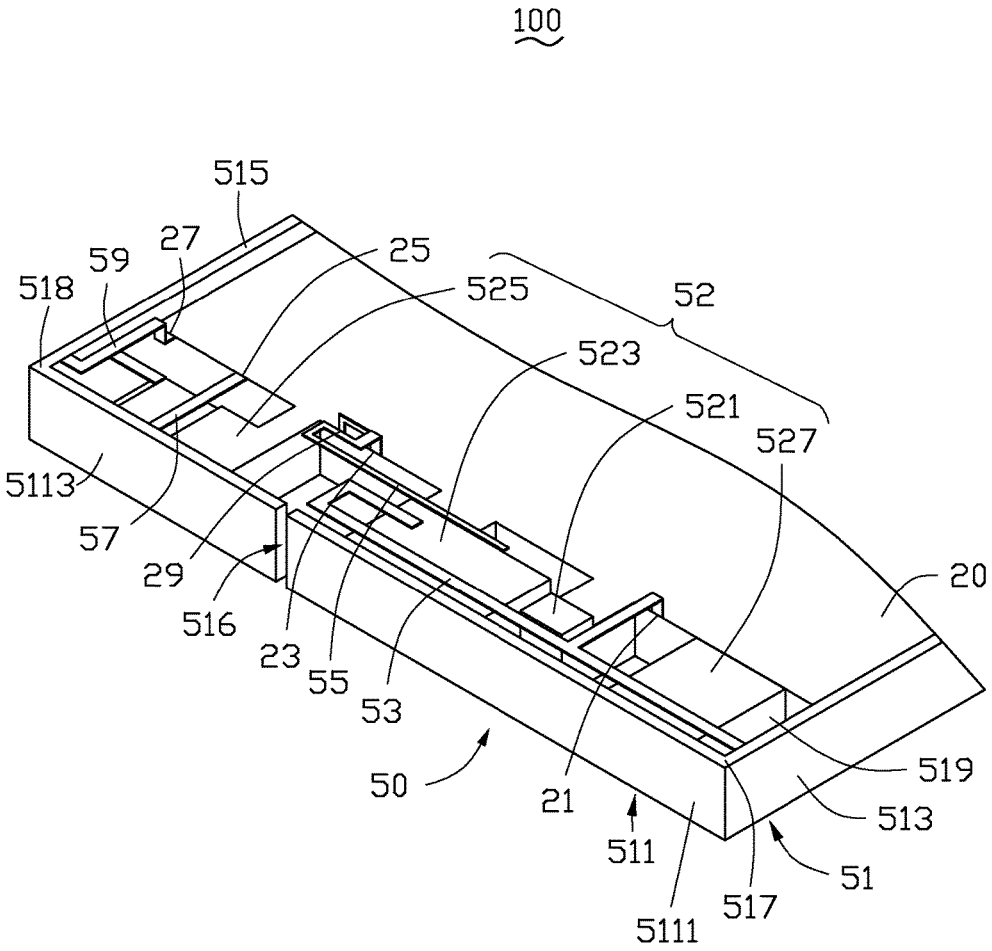
FIG. 1 is an isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wireless communication device 100. The wireless communication device 100 may be a mobile phone or a personal digital assistant, for example. The wireless communication device 100 includes a circuit board 20 and an antenna structure 50. The circuit board 20 includes a first feed pin 21, a second feed pin 23, a third feed pin 25, a fourth feed pin 27, and a ground pin 29. In this embodiment, the first feed pin 21, the second feed pin 23, the third feed pin 25, and the fourth feed pin 27 are configured to provide current to the antenna structure 50. The ground pin 29 is configured to ground the antenna structure 50.

The antenna structure 50 includes a metal member 51, at least one electronic member 52, a first antenna 53, a second antenna 55, a third antenna 57, and a fourth antenna 59. The first antenna 53, the third antenna 57, and the fourth antenna 59 are all electronically connected to the metal member 10. The first antenna 53, the second antenna 55, the third antenna 57, and the fourth antenna 59 are all electronically connected to the circuit board 20.

The metal member 51 can be a part of a metal housing of the wireless communication device 100. In this embodiment, the metal member 51 includes a sidewall 511, a first end wall 513, and a second end wall 515. The first end wall 513 and the second end wall 515 are perpendicularly positioned at two opposite ends of the sidewall 511, respectively. A gap 516 is defined at a substantially middle position of the sidewall 511 to divide the sidewall 511 into a first combining portion 5111 and a second combining portion 5113. The first combining portion 5111 is coupled to the first end wall 513, to jointly form a first frame assembly 517. The second combining portion 5113 is coupled to the second end wall 515, to jointly form a second frame assembly 518. As illustrated, the first frame assembly 517 and the second frame assembly 518 cooperatively form a receiving space 519.

In this embodiment, the at least one electronic element 52 includes a microphone 521, a speaker 523, a front camera 525, and a back camera 527. The microphone 521, the speaker 523, the front camera 525, and the back camera 527 are all received in the receiving space 519 and are electronically connected to a corresponding function module mounted on the circuit board 20.

Figure 2:
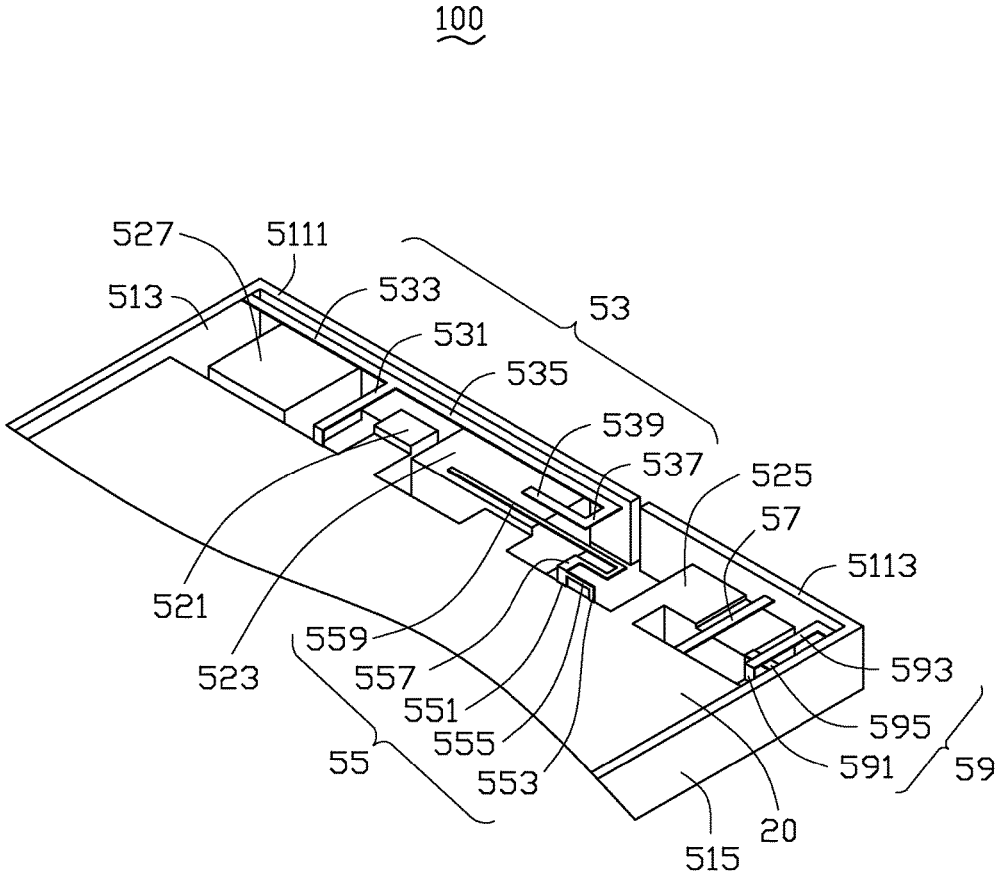
FIG. 2 is similar to FIG. 1, but shown from another angle.

FIG. 2 illustrates that the first antenna 53 includes a first feed portion 531, a first radiating section 533, a second radiating section 535, a third radiating section 537, and a fourth radiating section 539. As illustrated, the first feed portion 531 is a substantially L-shaped sheet and is positioned between the microphone 521 and the back camera 527. The first feed portion 531 has a first portion which is positioned in a plane substantially perpendicular to a plane in which the circuit board 20 is positioned and electronically connected to the first feed pin 21 of the circuit board 20 to feed current to the first antenna 53. The first feed portion 531 also has a second portion which is positioned in a plane substantially parallel with the plane in which the circuit board 20 is positioned and is electronically connected to the first radiating section 533 and the second section 535.

The first radiating section 533 is positioned in a plane substantially parallel to a plane in which the circuit board 20 is positioned. In this embodiment, the first radiating section 533 is coplanar with the second portion of the first feed portion 531. The first radiating section 533 has a first end perpendicularly connected to an end of the first feed portion 531 and a second end perpendicularly connected to the first end wall 513. In this embodiment, the first radiating section 533 is a substantially rectangular strip and is parallel with the first combining portion 5111.

The second radiating section 535, the third radiating section 537, and the fourth radiating section 539 are coplanar with the first radiating section 533. The second radiating section 535 is a substantially rectangular strip. The second radiating section 535 is perpendicularly connected to an end of the first feed portion 531 opposite to the first radiating section 533 and is collinear with the first radiating section 533. In this embodiment, an end of the second radiating section 535 away from the first radiating section 533 is also collinear with an edge of the gap 516. The third radiating section 537 is electronically connected to an end of the second radiating section 535 away from the first radiating section 533 and extends away from the sidewall 511 parallel with the first end wall 513. The fourth radiating section 539 is electronically connected to an end of the third radiating section 537 away from the second radiating section 535 and extends towards the first end wall 513 parallel with the sidewall 511.

The second antenna 55 includes a second feed portion 551, a ground portion 553, a transitional portion 555, a connecting portion 557, and a coupling portion 559. The second feed portion 551, the ground portion 553, and the transitional portion 555 cooperatively form a substantially U-shaped structure. The second feed portion 551, the ground portion 553, and the transitional portion 555 are positioned in a plane substantially perpendicular to the plane in which the circuit board 20 is positioned and are positioned between the speaker 523 and the front camera 525. The second feed portion 551 is parallel to and spaced from the ground portion 553. The second feed portion 551 is electronically connected to the second feed pin 23 of the circuit board 20 to feed current to the second antenna 50. The ground portion 553 is electronically connected to the ground pin 29 of the circuit board 20 to ground the second antenna 55. One end of the transitional portion 555 is substantially perpendicularly connected to an end of the second feed portion 551 away from the second feed pin 23. Another end of the transitional portion 555 is substantially perpendicularly connected to an end of the second ground portion 553 away from the ground pin 29.

The connecting portion 557 and the coupling portion 559 are positioned in a plane parallel to the plane in which the circuit board 20 is positioned. In this embodiment, the connecting portion 557 and the coupling portion 559 are coplanar with the first radiating section 533. The connecting portion 557 is a substantially L-shaped strip. The connecting portion 557 is electronically connected to a junction between the second feed portion 551 and the transitional portion 555, then extends towards the second combining portion 5113 parallel to the first end wall 513, and extends towards the second end wall 515 parallel to the sidewall 511. The coupling portion 559 is a substantially L-shaped strip. The coupling portion 559 is electronically connected to an end of the connecting portion 557 away from the junction between the second feed portion 551 and the transitional portion 555, then extends towards the second combining portion 5113 parallel to the first end wall 513, and extends towards the first end wall 513 parallel to the sidewall 511 until exceeds the fourth radiating section 539.

The third antenna 57 is a substantially rectangular strip and is positioned above the front camera 525. In this embodiment, the third antenna 57 is coplanar with the connecting portion 557 and the coupling portion 559. A first end of the third antenna 57 is perpendicularly connected to the third feed pin 25 of the circuit board 20 to feed current to the third antenna 57. A second end of the third antenna 57 is perpendicularly connected to the second combining portion 5113.

The fourth antenna 59 is positioned between the front camera 525 and the second end wall 515. The fourth antenna 59 includes a third feed portion 591, an extending portion 593, and a resonance portion 595. The third feed portion 591 is a substantially L-shaped sheet. The third feed portion 591 has a first portion which is coplanar with the circuit board 20 and is electronically connected to the fourth feed pin 27 of the circuit board 20 to feed current to the fourth antenna 59. The third feed portion 591 also has a second portion which is positioned in a plane perpendicular to the plane in which the circuit board 20 is positioned and is electronically connected to the extending portion 593. The extending portion 593 is a substantially L-shaped sheet and is coplanar with the third antenna 57. The extending portion 593 is perpendicularly connected to the second portion of the third feed portion 591, then extends towards the second combining portion 5113 parallel to the second end wall 515, and extends towards the second end wall 515 parallel to the second combining portion 5113 until which is electronically connected to the second end wall 515. The resonance portion 595 is a substantially rectangular strip and is positioned between the second end wall 515 and the front camera 525. The resonance portion 595 is parallel to the second combining portion 5113 and is electronically connected between the front camera 525 and the second end wall 515.

Figure 3:
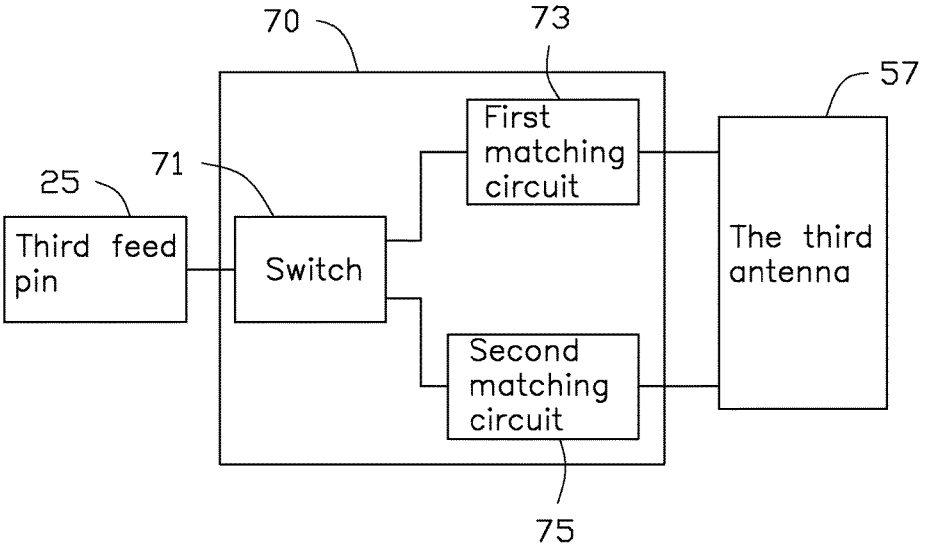
FIG. 3 is a block diagram of a matching circuit of the wireless communication device of FIG. 1.

FIG. 3 shows the wireless communication device 100 further includes a matching circuit 70. The matching circuit 70 is electronically connected between the third feed pin 25 of the circuit board 20 and the third antenna 57 to match an impedance of the antenna structure 50 for adjusting a high-frequency mode of the antenna structure 50. In this embodiment, the matching circuit 70 includes a switch 71, a first matching circuit 73, and a second matching circuit 75. The first matching circuit 73 and the second matching circuit 75 can both include a plurality of capacitors and inductors. The first matching circuit 73 and the second matching circuit 75 are both electronically connected to the third feed portion 25 through the switch 71. The first matching circuit 73 and the second matching circuit 75 are also both electronically connected to the third antenna 57.

When current is input to the antenna structure 50 via the first feed pin 21, the second feed pin 23, the third feed pin 25, and the fourth feed pin 27, the first antenna 53, the second antenna 55, the third antenna 57, and the fourth antenna 59 receive the current. The current flows through the first antenna 53, the first combining portion 5111, a junction between the first antenna 53 and the first combining portion 5111, the group of electronic elements 52, and the gap 516 to respectively obtain a low-frequency mode and a first high-frequency mode. The current flows through the second antenna 55, the group of electronic elements 52, and the gap 516 to obtain a second high-frequency mode. The current flows through the third antenna 57, the second combining portion 5113, the fourth antenna 59, a junction between the third antenna 57 and the second combining portion 5113, the group of electronic elements 52, the resonance portion 595, and the gap 516 to obtain a third high-frequency mode. The current flows through the fourth antenna 59, the second combining portion 5113, a junction between the fourth antenna 59 and the second combining portion 5113, the group of electronic elements 52, the resonance portion 595, and the gap 516 to obtain a fourth high-frequency mode. In this embodiment, the low-frequency mode has a frequency band of about 880-960 MHz. The first high-frequency mode has a frequency band of about 1710-1880 MHz. The second high-frequency mode has a frequency band of about 2400-2480 MHz. The third high-frequency mode has a frequency band of about 1850-2690 MHz. The fourth high-frequency mode has a central frequency of about 1575 MHz.

Figure 4:
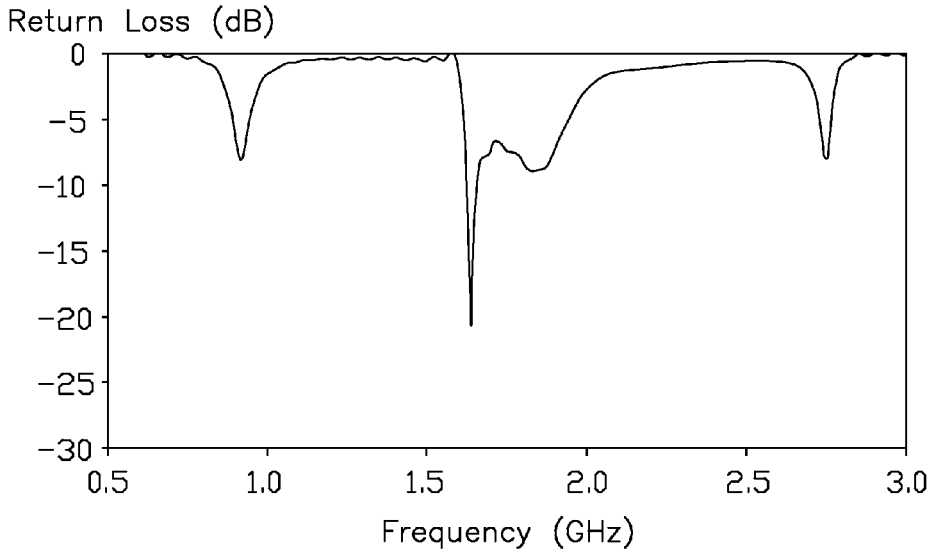
FIG. 4 is a return loss (RL) graph of a first antenna of the wireless communication device of FIG. 1.

FIG. 4 is a return loss (RL) graph of the first antenna 53 of the antenna structure 50. The first antenna 53 has a good performance when operating at a frequency band of about 880-960 MHz and 1710-1880 MHz.

Figure 5:
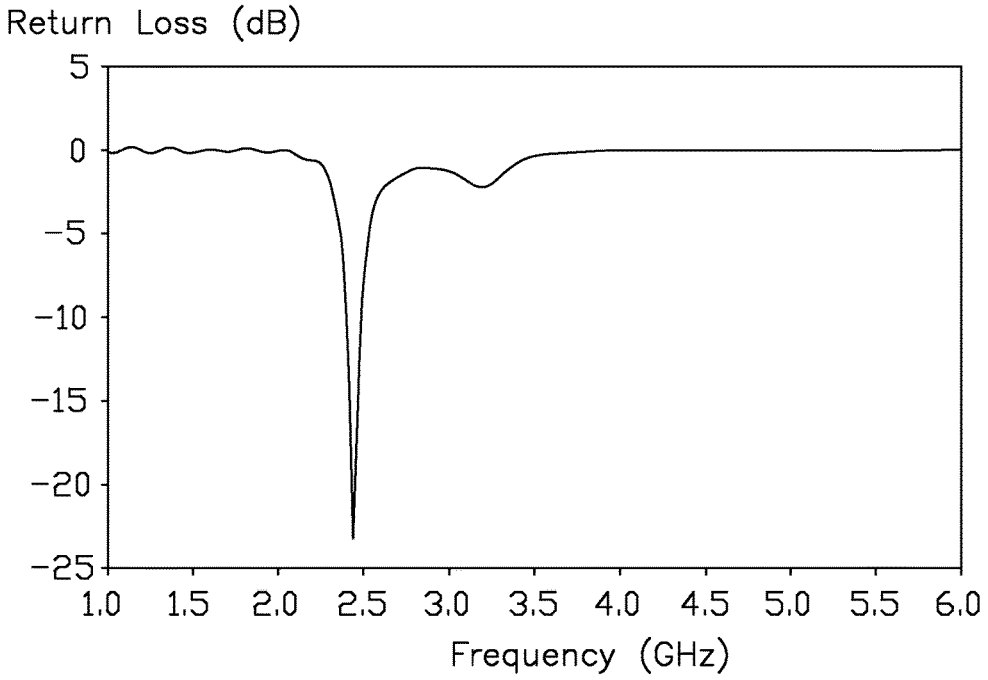
FIG. 5 is a RL graph of a second antenna of the wireless communication device of FIG. 1.

FIG. 5 is a RL graph of the second antenna 55 of the antenna structure 50. The second antenna 55 has a good performance when operating at a frequency band of about 2400-2480 MHz.

Figure 6:
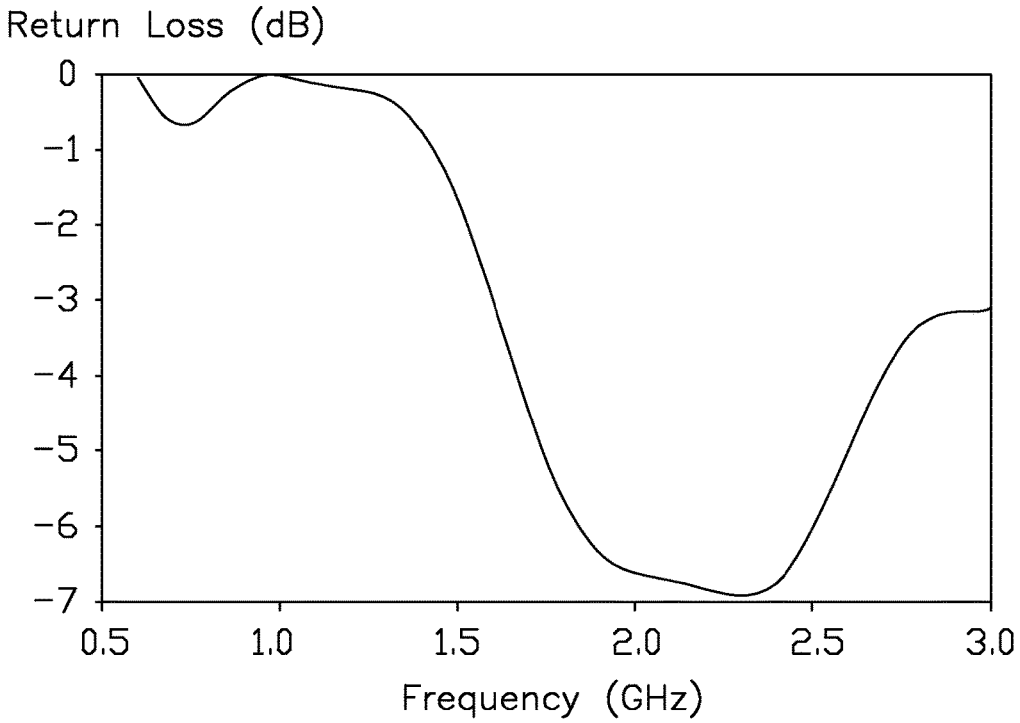
FIG. 6 is a RL graph of a third antenna of the wireless communication device of FIG. 1, showing a switch selects a first matching circuit.

FIG. 6 is a RL graph of the third antenna 57 of the antenna structure 50 when the switch 71 selects the first matching circuit 73. The third antenna 57 has a good performance when operating at a frequency band of about 1850-2690 MHz.

Figure 7:
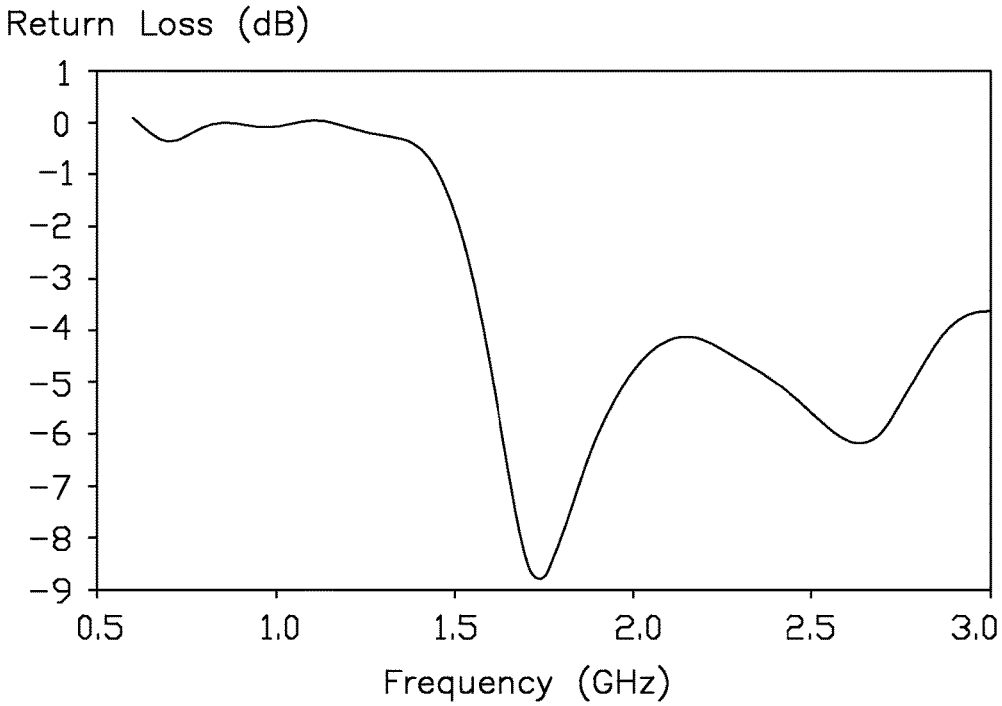
FIG. 7 is similar to FIG. 6, but showing the switch selects a second matching circuit.

FIG. 7 is a RL graph of the third antenna 57 of the antenna structure 50 when the switch 71 selects the second matching circuit 75. The third antenna 57 has a good performance when operating at a central frequency of about 1575 MHz.

Figure 8:
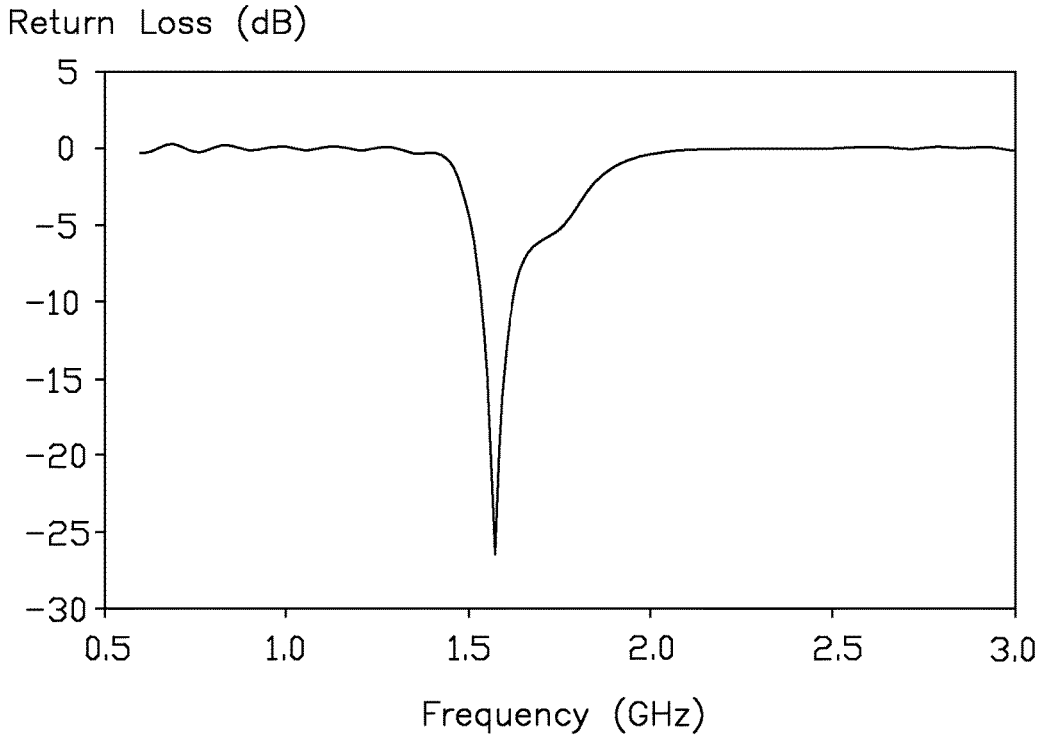
FIG. 8 is a RL graph of a fourth antenna of the wireless communication device of FIG. 1.

FIG. 8 is a RL graph of the fourth antenna 59 of the antenna structure 50. The fourth antenna 59 also has a good performance when operating at the central frequency of about 1575 MHz.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure, comprising:

a metal member, a gap defined on the metal member to divide the metal member into a first frame assembly and a second frame assembly, the first frame assembly and the second frame assembly cooperatively forming a receiving space configured for accommodating at least one electronic element;

a first antenna;

a second antenna;

a third antenna; and a fourth antenna; wherein the first antenna, the second antenna, the third antenna, and the fourth antenna are received in the receiving space, the first antenna is electronically connected to the first frame assembly of the metal member, and the third antenna and the fourth antenna are both electronically connected to the second frame assembly of the metal member;

wherein the first antenna comprises a first feed portion, a first radiating section, a second radiating section, a third radiating section, and a fourth radiating section; the first feed portion feeds current to the first antenna, the first radiating section has a first end perpendicularly connected to an end of the first feed portion closer to the first combining portion and a second end perpendicularly connected to the first end wall; the second radiating section is perpendicularly connected to an end of the first feed portion opposite to the first radiating section and is collinear with the first radiating section; the third radiating section is electronically connected to an end of the second radiating section away from the first radiating section and extends away from the sidewall parallel with the first end wall, the fourth radiating section is electronically connected to an end of the third radiating section away from the second radiating section and extends towards the first end wall parallel with the sidewall.

2. The antenna structure as claimed in claim 1, wherein the metal member comprises a sidewall, a first end wall, and a second end wall, the first end wall and the second end wall are respectively positioned at two opposite ends of the sidewall, the gap is defined in the sidewall to divide the sidewall into a first combining portion and a second combining portion; the first combining portion and the first end wall jointly form the first frame assembly, the second combining portion and the second end wall jointly form the second frame assembly.

3. The antenna structure as claimed in claim 1, wherein an end of the second radiating section is also collinear with an edge of the gap.

4. The antenna structure as claimed in claim 2, wherein the second antenna comprises a second feed portion, a ground portion, a transitional portion, a connecting portion, and a coupling portion, the second feed portion is parallel to and spaced from the ground portion; the second feed portion feeds current to the second antenna; the ground portion grounds the second antenna, the transitional portion is perpendicularly connected between the second feed portion and the ground portion, the connecting portion is electronically connected to a junction between the second feed portion and the transitional portion, then extends towards the second combining portion parallel to the first end wall, and extends towards the second end wall parallel to the sidewall; and the coupling portion is electronically connected to an end of the connecting portion away from the junction between the second feed portion and the transitional portion, then extends towards the second combining portion parallel to the first end wall, and extends towards the first end wall parallel to the sidewall.

5. The antenna structure as claimed in claim 2, wherein a first end of the third antenna feeds current to the third antenna, and a second end of the third antenna is perpendicularly connected to the second combining portion.

6. The antenna structure as claimed in claim 2, wherein the fourth antenna comprises a third feed portion and an extending portion, the third feed portion has a first portion for feeding current to the fourth antenna and a second portion electronically connected to the extending portion; the extending portion is perpendicularly connected to the second portion of the third feed portion, then extends towards the second combining portion parallel to the second end wall, and extends towards the second end wall parallel to the second combining portion until which is electronically connected to the second end wall.

7. The antenna structure as claimed in claim 6, wherein the fourth antenna further comprises a resonance portion, the resonance portion is parallel to the second combining portion and is electronically connected between one of the group of electronic elements and the second end wall.

8. A wireless communication device, comprising:

a circuit board having a first feed pin, a second feed pin, a third feed pin, a fourth feed pin, and a ground pin; and an antenna structure, comprising:

a metal member, a gap defined on the metal member to divide the metal member into a first frame assembly and a second frame assembly, the first frame assembly and the second frame assembly cooperatively forming a receiving space;

at least one electronic element;

a first antenna electronically connected to the first feed pin;

a second antenna electronically connected to the second feed pin and the ground pin;

a third antenna electronically connected to the third feed pin; and a fourth antenna electronically connected to the fourth feed pin; wherein the group of electronic element, the first antenna, the second antenna, the third antenna, and the fourth antenna are received in the receiving space, the first antenna is electronically connected to the first frame assembly of the metal member, and the third antenna and the fourth antenna are both electronically connected to the second frame assembly of the metal member;

wherein the first antenna comprises a first feed portion, a first radiating section, a second radiating section, a third radiating section, and a fourth radiating section; the first feed portion feeds current to the first antenna, the first radiating section has a first end perpendicularly connected to an end of the first feed portion closer to the first combining portion and a second end perpendicularly connected to the first end wall; the second radiating section is perpendicularly connected to an end of the first feed portion opposite to the first radiating section and is collinear with the first radiating section; the third radiating section is electronically connected to an end of the second radiating section away from the first radiating section and extends away from the sidewall parallel with the first end wall, the fourth radiating section is electronically connected to an end of the third radiating section away from the second radiating section and extends towards the first end wall parallel with the sidewall.

9. The wireless communication device as claimed in claim 8, further comprising a matching circuit, wherein the matching circuit is electronically connected between the third feed pin of the circuit board and the third antenna to match an impedance of the antenna structure.

10. The wireless communication device as claimed in claim 9, wherein the matching circuit comprises a switch, a first matching circuit, and a second matching circuit, the first matching circuit and the second matching circuit are both electronically connected to the third feed portion through the switch, the first matching circuit and the second matching circuit are also both electronically connected to the third antenna.

11. The wireless communication device as claimed in claim 8, wherein the metal member comprises a sidewall, a first end wall, and a second end wall, the first end wall and the second end wall are respectively positioned at two opposite ends of the sidewall, the gap is defined in the sidewall to divide the sidewall into a first combining portion and a second combining portion; the first combining portion and the first end wall jointly form the first frame assembly, the second combining portion and the second end wall jointly form the second frame assembly.

12. The wireless communication device as claimed in claim 8, wherein an end of the second radiating section is also collinear with an edge of the gap.

13. The wireless communication device as claimed in claim 11, wherein the second antenna comprises a second feed portion, a ground portion, a transitional portion, a connecting portion, and a coupling portion, the second feed portion is parallel to and spaced from the ground portion; the second feed portion feeds current to the second antenna; the ground portion grounds the second antenna, the transitional portion is perpendicularly connected between the second feed portion and the ground portion, the connecting portion is electronically connected to a junction between the second feed portion and the transitional portion, then extends towards the second combining portion parallel to the first end wall, and extends towards the second end wall parallel to the sidewall; and the coupling portion is electronically connected to an end of the connecting portion away from the junction between the second feed portion and the transitional portion, then extends towards the second combining portion parallel to the first end wall, and extends towards the first end wall parallel to the sidewall.

14. The wireless communication device as claimed in claim 11, wherein a first end of the third antenna feeds current to the third antenna, and a second end of the third antenna is perpendicularly connected to the second combining portion.

15. The wireless communication device as claimed in claim 11, wherein the fourth antenna comprises a third feed portion and an extending portion, the third feed portion has a first portion for feeding current to the fourth antenna and a second portion electronically connected to the extending portion; the extending portion is perpendicularly connected to the second portion of the third feed portion, then extends towards the second combining portion parallel to the second end wall, and extends towards the second end wall parallel to the second combining portion until which is electronically connected to the second end wall.

16. The wireless communication device as claimed in claim 15, wherein the fourth antenna further comprises a resonance portion, the resonance portion is parallel to the second combining portion and is electronically connected between one of the group of electronic elements and the second end wall.

* * * * *